US006210208B1

(12) United States Patent
Barnes et al.

(10) Patent No.: US 6,210,208 B1
(45) Date of Patent: Apr. 3, 2001

(54) QUICK CONNECT TERMINAL AND TERMINAL BLOCK

(75) Inventors: Ronald L. Barnes, Columbus, MS (US); Robert K. Cockrell, Vernon, AL (US)

(73) Assignee: Emerson Electric Company, St Louis, MO (US)

( * ) Notice: Subject to any disclaimer, the term of this patent is extended or adjusted under 35 U.S.C. 154(b) by 0 days.

(21) Appl. No.: 09/398,651

(22) Filed: Sep. 17, 1999

(51) Int. Cl.[7] ..... H01R 4/24

(52) U.S. Cl. ..... 439/441; 439/437; 439/439; 219/536; 219/541; 392/501; 392/455

(58) Field of Search ..... 439/439, 436, 439/437, 438, 440, 441, 828, 834, 835; 219/536, 541; 392/500, 501, 455

(56) References Cited

U.S. PATENT DOCUMENTS 3,629,794 * 12/1971 Kourimsky ..... 439/440
3,646,582 * 2/1972 Van Alphen et al. ..... 439/441
3,916,149 * 10/1975 Skinner ..... 439/437
4,036,545 * 7/1977 Mysiak et al. ..... 439/441

FOREIGN PATENT DOCUMENTS

1536189 * 12/1978 (GB) ..... 439/439
2049307 * 12/1980 (GB) ..... 439/439

* cited by examiner

*Primary Examiner*—Paula Bradley
*Assistant Examiner*—Tho D. Ta
(74) *Attorney, Agent, or Firm*—Polster, Lieder, Woodruff & Lucchesi, L.C.

(57) ABSTRACT

A screwplug type water heating unit (10) has a body (12) through which ends (14*a,* 14*b*) of a heating element (14) extend. Separate terminal quick connects (22) have tabs (38*a,* 38*b*) which engage the ends of the heating element. Electrical leads (L1, L2) which connect with the ends of the heating element are separately engaged in slots (50) of each terminal quick connect by an engagement tab (60) so the heating element is electrically connected in a circuit supplying power to the heating unit. A terminal block (24) attaches to an outer face (26) of the screwplug. The terminal block has openings (94*a,* 94*b,* 96*a,* 96*b,* 98*a,* 98*b*) in it by which the terminal quick connects are installed in the terminal block. The terminal quick connects each have a tab (70) received in a slot (98*a,* 98*b*) formed in the terminal block to attach the terminal quick connects to the terminal block.

29 Claims, 2 Drawing Sheets

QUICK CONNECT TERMINAL AND TERMINAL BLOCK

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to electrical connectors used to connect the heating element of a heating unit installed in a water heater or the like, and more particularly, to a quick connect terminal and terminal block which provides a simplified way of connecting electrical leads to the heating element, this being accomplished without the use of screwdrivers or similar type tools.

Heating units used in water heaters are well-known in the art. Conventional units include a screwplug which is screwed into a threaded opening in a sidewall of a water heater tank. The heating element has an elongate U-shape and extends well into the interior of the tank. Terminal ends of the heating element extend through the screwplug for electrical leads to be connected to the respective ends of the heating element. These connections have heretofore typically been made by soldering an end of the lead to an end of the heating element, by wrapping a portion of the lead about a screw and threading the screw into a threaded hole using a screwdriver, or by otherwise permanently connecting the two together. A drawback with these previous techniques is that they involve a great deal of manual labor which adds to the time and cost of completion of the assembly.

BRIEF SUMMARY OF THE INVENTION

Among the several objects of the present invention may be noted the provision of a resistance heating unit for use in a water heater, the heating unit being a screwplug type unit having a heating element with terminal ends which extend through the screwplug;

the provision of such a heating unit employing a new method of attaching the terminal ends of the heating element into an electrical circuit by which current is directed through the heating element to heat the water;

the provision of such a new method to include, in combination, a terminal quick connect and a terminal block in which the terminal quick connect is installed;

the provision of such a method to employ a separate quick connect for connecting each end of the heating element with an electrical lead, both quick connects being installed in the terminal block;

the provision of each terminal quick connect to separately engage an end of the heating element and the electrical lead to which the heating element connects;

the provision of each terminal quick connect to be of an electrically conductive material with the end of the heating element frictionally fitting into one portion of the quick connect, and the electrical lead being captured at another portion of the quick connect;

the provision of each terminal quick connect to include a slot in which the electrical lead is captured, the lead being readily and automatically inserrtable into the slot and not requiring manual labor to complete the electrical connection;

the provision of each terminal quick connect to permanently secure the end of the heating element and the electrical lead together;

the provision of the terminal block to be an electrically non-conductive material and to include provisions for separately securing each terminal disconnect in place and electrically isolated from each other so the terminations cannot short together;

the provision of such a terminal block in which the terminal quick connects are easily installed and from which they cannot be removed or dislodged; and, the provision of such a new method of installation which simplifies manufacture of the heating unit, eliminates current manufacturing steps so to lower the manufactured cost of a heating unit, yet which provides a reliable heating unit which is readily installed in a water heater.

In accordance with the invention, generally stated, apparatus is provided which facilitates electrical connection of a heating element used in a water heater heating unit. The heating unit is a screwplug type unit having a body through which the ends of the heating element pass. A separate terminal quick connect frictionally engages each end of the heating element. The electrical lead which connects with the end of the heating element is separately engaged by the terminal quick connect so the end of the heating element is electrically connected in the circuit supplying power to the heating unit. A terminal block attaches to an outer face of the screwplug. The terminal block has a set of openings in it in which the terminal quick connects are received. The terminal quick connects each have a tab received in a slot formed in the terminal block to secure the terminal quick connects to the terminal block. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1A:
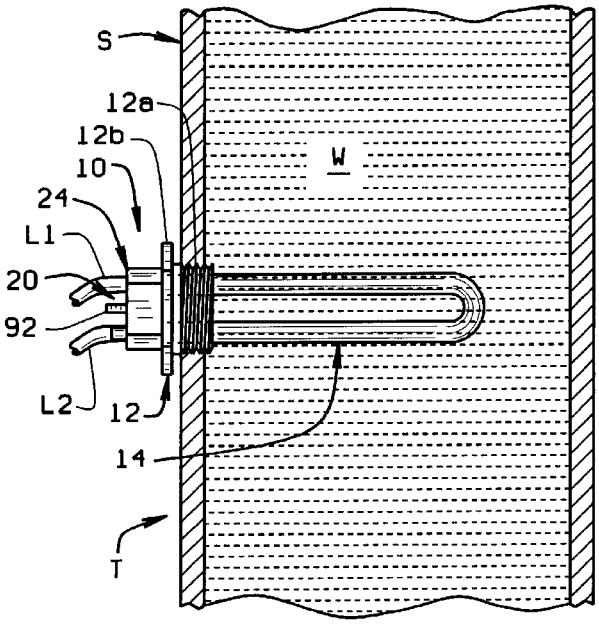
FIG. 1A is a simplified representation of a section of a water heater in which a screwplug type water heater is installed.
Figure 1B:
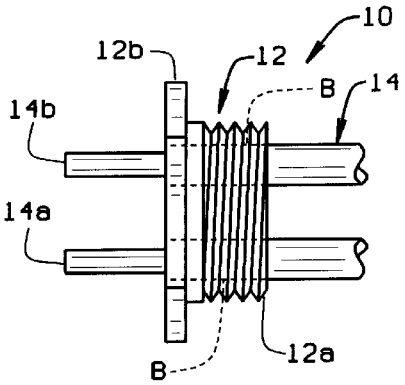
FIG. 1B illustrates a body portion of the screwplug with the ends of heating element extending through it.

Referring to the drawings, a heater unit 10 is for heating water W contained in a water heater tank T such as is well-known in the art. As shown in FIGS. 1A and 1B, heater 10 is a screwplug type unit having a body 12 and a heating element 14. The heating element has an elongate U-shape, and the body has a threaded plug portion 12*a* for screwing the heater unit into a threaded bore in the water tank sidewall S. The outer end of the screwplug body has a flange section 12*b* which is of a hexagonal shape, for example. In FIG. 1B, the ends 14*a,* 14*b* of the heating element are shown to extend through longitudinal bores B in the screwplug body and to project a distance past the flange end of the body.

Once installed, it is necessary to connect the heater unit into an electrical circuit by which power is supplied to the heating element. In the drawings, this circuit is represented by the electrical leads L1, L2. Heretofore, the leads have been connected to the ends of the heating element in various ways as is known to those skilled in the art. While these ways are not described, they all require the installer to use tools of some sort such as screwdrivers, or to solder the leads to the ends of the heating element. As noted above, this is a time consuming process which adds to the manufactured cost of the water tank.

Figure 2:
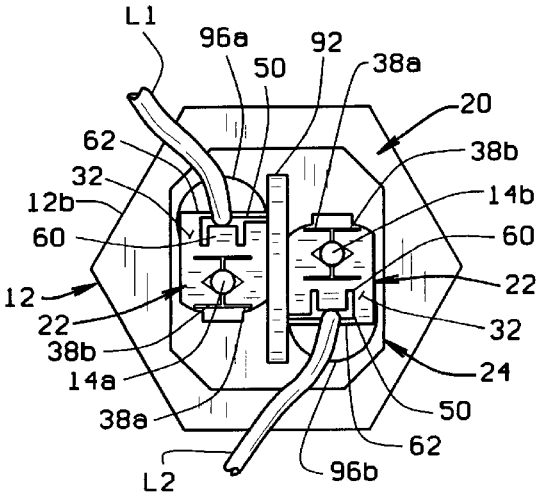
FIG. 2 is an end view of the heater unit illustrating the apparatus of the present invention for electrically connecting the ends of the heating element into an electrical circuit.

The apparatus of the present invention is indicated generally 20 in FIG. 2. As shown therein, and as described hereinafter, the apparatus first includes one, and preferably a pair of terminal quick connects indicated generally 22. These units each frictionally engage one end 14*a* or 14*b* of heating element 14. Further, each terminal quick connect unit separately engages one of the electrical leads to which an end of the heating element is electrically connected, thus connecting the heating element into the power circuit. In addition, apparatus 20 includes a terminal block 24 which is attached in any convenient manner to an outer surface 26 of the flange. As described hereinafter, the terminal quick connects are installed in and secured to the terminal block.

Figure 4A:
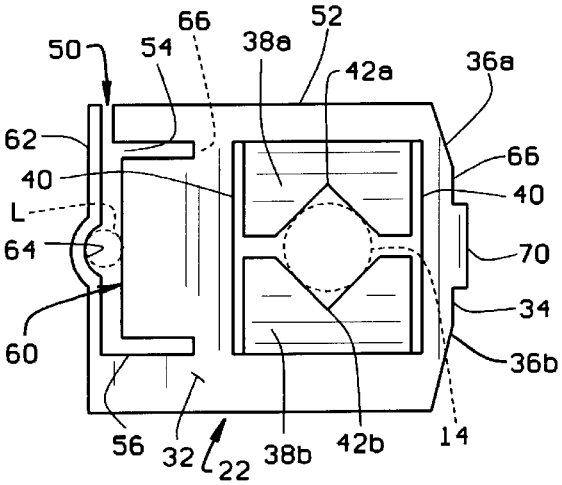
FIG. 4A is a top plan view of a terminal quick connect of the apparatus; and, FIGS. 4B, 4C, and 4D are respective side elevational views of the terminal quick connect.

In FIGS. 4A–4D, one of the terminal quick connects 22 is shown. The other unit is identical to the one shown and will not be described. The terminal quick connect unit first includes a plate 32 made of an electrically conductive material. The plate is generally rectangular in plan. At one end 34 of the plate, the edges 36*a,* 36*b* are chamfered as shown in FIG. 4A. On the side of plate 32 inwardly of end 34 is formed a pair of opposed tabs 38*a,* 38*b* for frictionally engaging one end of the heating element. These tabs are formed by a cutting operation in which two parallel slits 40 are cut into the top of plate 32. These slits extend parallel to side 34 of the plate. Another slit extends perpendicular to the slits 40 and extends between these slits. Respective correspondingly formed notches 42*a,* 42*b* are now made in abutting sides of the opposed tabs. These notches are V shaped notches and their size is such as to accommodate an end of the heating unit. Both of the tabs 38*a,* 38*b* are bent outwardly away from the outer, flange end of the screwplug body when the apparatus is in place. The tabs extend outwardly from the plate at corresponding angles with respect to the plate. End 14*a* or 14*b* of the heating element extends through the opening formed by the notches from the underside of the plate. The tabs 38*a,* 38*b* now frictionally engage this outer end of the heating element and prevent its withdrawal from engagement with the tabs.

Referring to FIG. 4A, a slot 50 is formed in plate 32. Slot 50 extends into the body of plate 32 from one side 52 of the plate. A first reach 54 of the slot extends transversely of a longitudinal axis of the plate and substantially across the width of the plate. A second reach 56 and third reach 58 of the slot extend lengthwise of the plate (orthogonally of reach 54) in the direction of the tabs 38*a,* 38*b*. As shown in the drawings, slot 50 defines an engagement tab 60 for engaging wire strands of a respective lead L so to electrically connect the lead to the plate. Reach 54 of slot 50 is formed adjacent one end 62 of plate 32, end 62 being downwardly turned to form a sidewall for the plate. Further, as shown in FIG. 4A, a notch or recess 64 is formed in the sidewall. The notch is sized to accommodate the wire strands for the electrical lead. During assembly of the heater unit, the insulation is stripped from the end of the lead to expose the wire strands which are then pushed through slot 50. As indicated in FIG. 4A, a line of weakness 66 allows engagement tab 60 to be depressed beneath the top surface of the plate. The angled surface of the engagement tab facilitates insertion of the lead into slot 50. Once the wire strands are in place, the engagement tab can be pushed against them to secure the electrical lead to the terminal quick connect. It will be noted that no tools are required to attach the electrical lead to the terminal quick connect. This saves manufacturing time and cost.

Figure 4D:
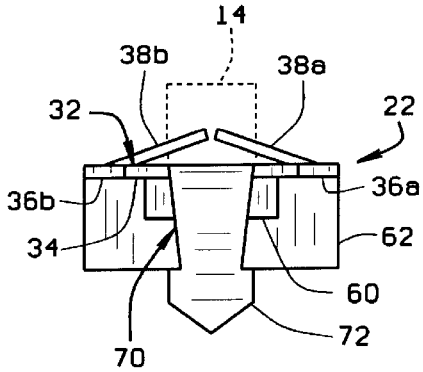
Figure 4B:
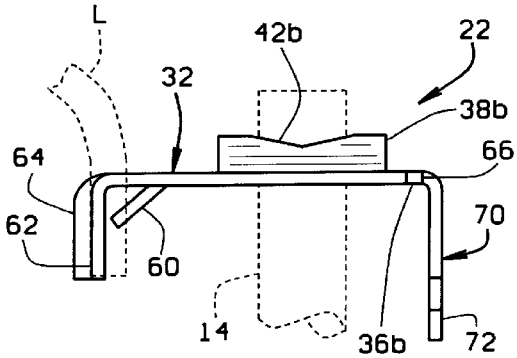
Figure 4C:
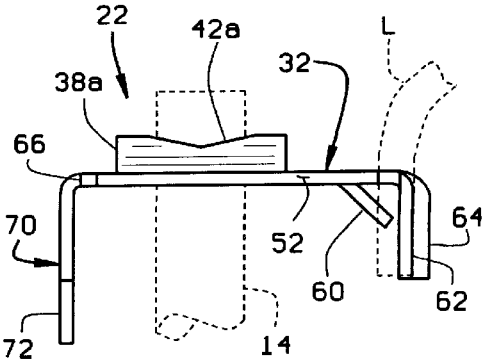

On opposite side 66 of plate 32 from side 62, a mounting tab 70 is formed. This mounting tab is used to attach terminal quick connect 22 to terminal block 24. As best shown in FIG. 4D, mounting tab 70 is a spear shaped tab which is centered along the length of side 66 and depends below the lower end of sidewall 62 of the terminal quick connect. The tab extends outwardly from the side of the plate and tapers inwardly from the upper end of the tab to where the lower spear shaped end 72 of the tab is formed.

Figure 3A:
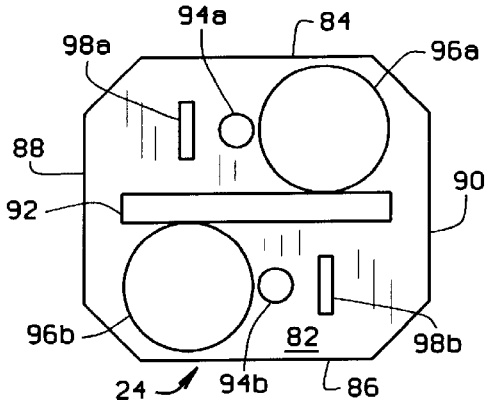
FIGS. 3A, 3B, and 3C are respective top plan, side elevational, and end elevational views of a terminal block portion of the apparatus.
Figure 3B:
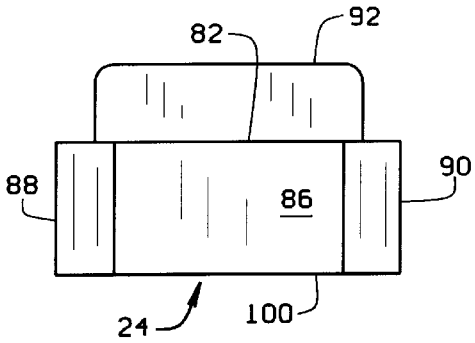
Figure 3C:
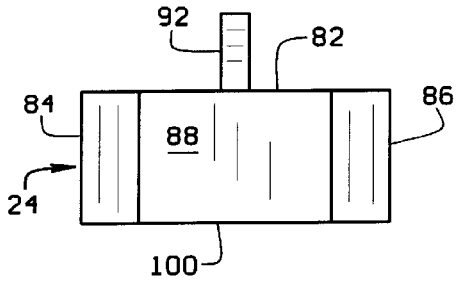

Referring to FIGS. 3A–3C, terminal block 24 has a generally rectangular base 82 with depending sidewalls 84, 86, and endwalls 88, 90. The corners of the terminal are each chamfered. The height of the sidewalls and endwalls are such that when mounted in place, the terminal quick connects do not touch outer face 26 of flange 12*b*. Plate 82 is divided in half by an upstanding, longitudinally extending wall 92. The terminal block is of an integrally formed, one-piece construction and is made of a plastic or other suitable non-electrically conductive material. One terminal quick connect is mounted one side of the terminal block, and the other terminal quick connect on the other. Wall 92 not only provides a handle to make the terminal block easy to grip and hold, but also serves to electrically isolate the two terminal quick connects so the heating element cannot be shorted out at the ends of the heating element.

Referring to FIG. 3A, plate 82, on each side of wall 92, has three identical sets of openings. One set of openings 94*a,* 94*b,* are circular openings sized for ends 14*a,* 14*b* of heating element 14 to be inserted through the openings. This set of openings is generally formed such that opening 94*a* is slightly to one side of the center of the terminal block, and opening 94*b* is slightly to the other side of center. The next set of openings 96*a,* 96*b* are oblong generally L-shaped openings which accommodate one end of a terminal quick connect 22. One leg of the openings extends generally parallel to wall 92 and the other leg perpendicular of the wall, toward the wall. The opening 96*a* is toward one end of the terminal block, and the other opening is toward the opposite end of the terminal block. The openings are sized so end 62 of plate 32 is received in the opening, as is engagement tab 60. Finally, a pair of slots 98*a,* 98*b,* extend perpendicular to wall 92. Slot 98*a* is formed on the opposite side of opening 94*a* from opening 96*a,* and slot 98*b* is on the opposite side of opening 94*b* from opening 96*b*. The width of the slots 96*a,* 96*b* is such that the respective mounting tabs 70 of the terminal quick connects fit into the slots to both capture the terminal quick connects in the terminal blocks, and align the terminal quick connects with respect to each other and the heater unit.

During fabrication of a heater unit, the ends 14*a,* 14*b* of heating element 14 are inserted through the bores B in body 12 so to extend a distance past flange 12*b*. Insulation is stripped from the ends of the respective leads L1, L2 exposing strands of wire at the end of each lead. The lead ends are then inserted in slot 50 of the respective terminal quick connects and pulled through the slots into the recess 64 formed in sidewall 62 of the terminal quick connect.

Engagement tab 60 is then pressed upwards against the wire to partially close the slot and attach the lead to the terminal quick connect.

After the leads are attached to the terminal quick connects, the mounting tab 70 of the respective units is aligned with the slot 98*a,* 98*b.* This further aligns the tabs 38*a,* 38*b* with a projecting end of heating element 14. When tab 70 is pushed into the slot 98*a* or 98*b,* the end of the heating element is pushed the notches 42*a,* 42*b* formed in the tabs 38*a,* 38*b.* This action deforms the tabs about the heating element so they frictionally engage the end of the heating element. When both terminal quick connects are in place, the base 100 of terminal 24 is seated against outer face 26 of flange 12*b* and secured to the face in any convenient manner. None of the above described process steps require use of screw drivers or similar tools previously required to complete the installation.

What has been described is apparatus and a method for attaching the terminal ends of the heating element into an electrical circuit by which current is directed through the heating element. The apparatus includes the combination of a pair of terminal quick connects made of an electrically conductive and a terminal block made of a non-conductive material in which the terminal quick connects are installed. A separate quick connect electrically connects each end of the heating element with an electrical lead, and both terminal quick connects are installed in the terminal block. One end of the heating element is frictionally engaged by one portion of the terminal quick connect and an electrical lead is captured in another portion of the terminal quick connect. Importantly, no tools are required to make the electrical connections or permanently attach the terminal quick connects to the terminal block. Once installed on the terminal blocks, the terminal quick connects are electrically isolated from each other so the terminations cannot short together. Finally, the method and apparatus of the invention simplifies manufacture of the heating unit and lowers the manufacturing cost of a heating unit, while providing a reliable heating unit which is readily installed and replaced.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for facilitating electrical connection of a heating element used in a heating unit for a water heater, the heating unit having a body through which at least one end of the heating element passes, the apparatus comprising:

a terminal quick connect frictionally engaging said at least one end of said heating element and separately engaging an electrical lead thereby electrically connecting said heating element into a circuit supplying power for the heating element; and, a terminal block attached to an outer surface of said body of said heating unit, said terminal block having an opening therein in which said terminal quick connect is received, and said terminal block having means securing said terminal quick connect to said terminal block.

2. The apparatus of claim 1 wherein said terminal quick connect is made of an electrically conductive material and said terminal block is made of an electrically non-conductive material.

3. The apparatus of claim 1 for facilitating electrical connection of a heating element used in a heating unit for a water heater or the like, the heating unit having a body through which said at least one end and a second end of the heating element pass, wherein said terminal quick connect frictionally engages the at least one end of said heating element and said terminal quick connect includes means separately engaging an electrical lead to which said at least one end of said heating element is electrically connected, and a second terminal quick connect frictionally engages the second end of said heating element and includes means separately engaging an electrical lead to which said second end of said heating element is electrically connected.

4. The apparatus of claim 1 wherein said terminal quick connect includes a plate in which is formed a pair of opposed tabs and said at least one end of said heating element is frictionally engaged by said tabs.

5. The apparatus of claim 4 wherein said opposed tabs include correspondingly formed notches in abutting sides thereof, said notches being of a size accommodating said at least one end of said heating element.

6. The apparatus of claim 5 wherein said opposed tabs each extend outwardly from an outer surface of said plate at corresponding angles with respect to said plate, and said at least one end of said heating element is inserted through said opening from an opposite side of said plate whereby said tabs frictionally engage said at least one end of said heating element and prevent withdrawal of said end of said heating element from engagement with said tabs.

7. The apparatus of claim 4 further including a slot formed in said plate for engaging strands of wire comprising said electrical lead.

8. The apparatus of claim 7 wherein said slot extends into said plate from one side thereof and defines an engagement tab for engaging said wire strands.

9. The apparatus of claim 8 wherein a reach of said slot is formed in said plate adjacent one end of said plate and said one end of said plate is downwardly turned to form a sidewall which facilitates insertion of wire strands into said slot.

10. The apparatus of claim 9 wherein said engagement tab defined by said slot is downwardly turned to provide an angled surface which further facilitates insertion of said wire strands into said slot, said engagement tab being movable against said wire strands once the wire strands are in place to engage the wire stands and prevent their movement.

11. The apparatus of claim 10 wherein said sidewall has a recess formed therein accommodating said wire.

12. The apparatus of claim 7 wherein said slot is formed adjacent one end of said plate and a mounting tab is formed on an opposite end of said plate.

13. The apparatus of claim 12 wherein said means for securing said terminal quick connect to said terminal block includes a slot formed in an outer surface of said terminal block and said mounting tab is engagingly received in said slot of said terminal block.

14. The apparatus of claim 3 wherein said terminal block has a separate opening therein in which each of said terminal quick connects is fixedly received.

15. The apparatus of claim 14 wherein said terminal quick connects are mounted on opposites sides of an outer face of said terminal block and said terminal block further includes a wall projecting outwardly from said outer face thereof between said terminal quick connects to isolate the terminal quick connects from each other.

16. In a screwplug heater for installation in a water heater, the screwplug heater including a threaded body received in a sidewall of the water heater and a resistance heating element, the ends of said heating element extending through said threaded body for electrical connection into a circuit supplying power to the screwplug heater, an apparatus for making said electrical connection without the use of tools and without requiring soldering, welding, or other methods of connection, the apparatus including:

a pair of terminal quick connects formed of an electrically conductive material, each terminal quick connect having means frictionally engaging an end of said heating element, and means separately engaging an electrical lead to which said end of said heating element is electrically connected thereby to connect said heating element into said circuit; and, a terminal block formed of an electrically non-conductive material and attached to an outer surface of said threaded body, said terminal block having separate openings therein in which said terminal quick connects are received, and said terminal block having means securing each said terminal quick connect to said terminal block.

17. The apparatus of claim 16 wherein each terminal quick connect includes a plate in which is formed a pair of opposed tabs with said end of said heating element frictionally engaged by said tabs.

18. The apparatus of claim 17 wherein said opposed tabs include correspondingly formed notches in abutting sides thereof, said notches being of a size accommodating said end of said heating element, said opposed tabs each extending outwardly from an outer surface of said plate at corresponding angles with respect to said plate, said end of said heating element being inserted through said opening from an opposite side of said plate with said tabs frictionally engaging said end of said heating element to prevent withdrawal of said end of said heating element from engagement with said tabs.

19. The apparatus of claim 18 further including a slot formed in said plate adjacent one end of the plate for engaging strands of wire comprising said electrical lead, said slot extending into said plate from one side thereof and defining an engagement tab for engaging said wire strands.

20. The apparatus of claim 19 wherein said slot has a reach formed in said plate adjacent said one end thereof, said one end of said plate being downwardly turned to form a sidewall which facilitates insertion of said wire strands into said slot, said sidewall having a recess formed therein accommodating said wire.

21. The apparatus of claim 20 wherein said engagement tab is downwardly turned to provide an angled surface which further facilitates insertion of said wire strands into said slot.

22. The apparatus of claim 21 wherein said slot is formed adjacent one end of said plate and a mounting tab for said terminal quick connect is formed on an opposite end of said plate.

23. The apparatus of claim 22 wherein said means securing said terminal quick connect to said terminal block includes a slot formed in an outer surface of said terminal block and said mounting tab is engagingly received in said slot of said terminal block.

24. The apparatus of claim 23 wherein said terminal quick connects are mounted on opposites sides of an outer face of said terminal block and said terminal block further includes a wall projecting outwardly from said outer face thereof between said terminal quick connects to isolate the terminal quick connects from each other.

25. In a heating unit having a heater element and a body through which ends of said heater element extend, a method of electrically connecting the ends of said heater element into an electrical circuit supplying power to the heating unit, the electrical connections being made without the use of tools and without requiring soldering or welding, the method comprising:

frictionally engaging separate ends of said heating element with one of a pair of terminal quick connects formed of an electrically conductive material;

separately engaging an electrical lead to which said end of said heating element is electrically connected on said terminal quick connect thereby to connect said heating element into said circuit; and, attaching each said terminal quick connect to a terminal block formed of an electrically non-conductive material and attached to an outer surface of said heater unit body, said terminal block having separate openings therein in which said terminal quick connects are fixedly received and said terminal block having means securing each said terminal quick connect to said terminal block.

26. The method of claim 25 wherein each terminal quick connect includes a plate in which is formed a pair of opposed tabs with said end of said heating element frictionally engaged by said tabs, said opposed tabs including correspondingly formed notches in abutting sides thereof, said notches being of a size accommodating said end of said heating element, said oppose tabs each extending outwardly from an outer surface of said plate at corresponding angles with respect to said plate, and said end of said heating element being inserted through said opening from an opposite side of said plate with said tabs frictionally engaging said end of said heating element to prevent withdrawal of said end of said heating element from engagement with said tabs.

27. The method of claim 26 wherein said plate farther includes a slot formed adjacent one end of the plate for engaging strands of wire comprising said electrical lead, said slot extending into said plate from one side thereof and defining an engagement tab for engaging said wire strands, said slot having a reach formed in said plate adjacent said one end thereof, said end being downwardly turned to form a sidewall which facilitates insertion of said wire strands into said slot, said sidewall having a recess formed therein accommodating said wire, and said engagement tab is downwardly turned to provide an angled surface which further facilitates insertion of said wire strands into said slot.

28. The method of claim 27 wherein said slot of said plate is formed adjacent one end of said plate and a mounting tab for said terminal quick connect is formed on an opposite end of said plate, and said means for securing said terminal quick connect to said terminal block includes a slot formed in an outer surface of said terminal block and said mounting tab is engagingly received in said slot in said outer surface of said terminal block.

29. The method of claim 28 wherein said terminal quick connects are mounted on opposites sides of an outer face of said terminal block and said terminal block further includes a wall projecting outwardly from said outer face thereof between said terminal quick connects to isolate the terminal quick connects from each other.

* * * * *